US006927867B2

(12) United States Patent
Nishikawa

(10) Patent No.: US 6,927,867 B2
(45) Date of Patent: Aug. 9, 2005

(54) OUTPUT CONTROL METHOD AND APPARATUS THEREFOR

(75) Inventor: Yoko Nishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 514 days.

(21) Appl. No.: 09/064,509

(22) Filed: Apr. 23, 1998

(65) Prior Publication Data

US 2002/0080383 A1 Jun. 27, 2002

(30) Foreign Application Priority Data

Apr. 25, 1997 (JP) ..... 9-109069

(51) Int. Cl.[7] ..... B41B 15/00
(52) U.S. Cl. ..... 358/1.15; 358/1.14; 358/1.16
(58) Field of Search ..... 395/114, 115, 395/116, 117; 358/296, 404, 1.14, 1.15, 1.16

(56) References Cited

U.S. PATENT DOCUMENTS

| | | | | |
|---|---|---|---|---|
| 4,586,147 A | | 4/1986 | Tadokoro | 702/184 |
| 5,638,428 A | * | 2/1995 | Berku et al. | 379/100 |
| 5,666,584 A | | 9/1997 | Akashi et al. | 399/9 |
| 5,748,880 A | | 9/1997 | Ito et al. | 714/46 |
| 5,845,057 A | * | 12/1998 | Takeda et al. | 395/114 |
| 5,995,204 A | * | 11/1999 | Hoshino et al. | 355/75 |

FOREIGN PATENT DOCUMENTS

| | | |
|---|---|---|
| JP | 58-136473 | 8/1983 |
| JP | 60-15185 | 1/1985 |
| JP | 04-315219 | 11/1992 |
| JP | 05-155111 | 6/1993 |
| JP | 06-340153 | 12/1994 |
| JP | 7-253956 | 10/1995 |
| JP | 08-063300 | 3/1996 |
| JP | 8-286955 | 11/1996 |
| JP | 9-081418 | 3/1997 |

* cited by examiner

*Primary Examiner*—Cheukfan Lee
(74) *Attorney, Agent, or Firm*—Fitzpatrick, Cella, Harper & Scinto

(57) ABSTRACT

An output control apparatus is used in an output apparatus adapted to form image data by analyzing an instruction received from an external apparatus and to output thus formed image data. The output control apparatus includes a memory for memorizing, in case of a change in the state in the apparatus, an identification code corresponding to the change, and an instruction unit for providing a test output instruction for instructing the output of set value information of the output apparatus. Also included is a control unit for controlling the output, if the identification code is memorized in the memory and in response to the instruction by the instruction unit, in such a manner as to output information corresponding to the identification code together with the set value information of the output apparatus.

34 Claims, 10 Drawing Sheets

FIG. 4

| ERROR NO. | LED STATUS ON ERROR | | | | | TYPE |
|---|---|---|---|---|---|---|
| | ERROR LED | MESSAGE LED | PAPER LED | DATA LED | PRINTABLE LED | |
| 50 | ON | | | ON | | FIXER FAILURE |
| 51 | ON | | | ON | | BD FAILURE |
| 52 | ON | | | ON | | POLYGON MOTOR FAILURE |
| 5F | ON | | | ON | | PRINTER POWER OFF |
| 67 | ON | | ON | | | CONTRADICTION IN MEM |

OUTPUT CONTROL METHOD AND APPARATUS THEREFOR

BACKGROUND OF THE INVENTION

1. Field of the Invention

The present invention relates to an output control method of analyzing output information from the outside, thereby controlling the output for forming a visible image, and an apparatus adapted for executing such method.

2. Related Background Art

In the conventional image forming apparatus provided with an operation panel, a display etc., in case of a state change in the apparatus to be informed to the user, such as a failure, an error message or a number is displayed on the display frame according to the type of such failure. Also in case of a failure in an apparatus in which the operation panel or the display is simplified, the status of the apparatus is approximately indicated by lighting or flickering of an LED or the like. Otherwise, the status of the apparatus is detailedly represented by transmission of information to a connected external equipment through a bidirectional interface.

In such conventional configurations, however, the apparatus equipped with the operation panel or the display device allows the user to confirm the error message or the error number in case of a failure, but the user is unable to confirm the history of such failures in the past when the apparatus is re-started since such information is not stored. Also, an apparatus with a simplified operation panel or display device is incapable of displaying the error message, and can only use limited devices such as a LED for indicating the status of the apparatus, so that the user cannot easily obtain detailed information in case of a failure of the apparatus. Also in the configuration of transmitting detailed information to the connected external equipment through the bidirectional interface, the detailed information of the failure may still be unavailable for example if the information cannot be transmitted to the outside for some reason or if the external equipment cannot receive the information because of a failure therein. Also, the content of the past failure cannot be confirmed when the apparatus is re-started because such failure information is not stored as in an apparatus provided with the operation panel and the display device.

SUMMARY OF THE INVENTION

The present invention is featured by detecting a failure generated in an apparatus by failure detecting means, assigning an identification code, to the generated failure, for identifying the kind of such generated failure by identification code assigning means, storing a table correlating the content of the failure and the identification code by means for storing such assigned code, then, in case of generation of a failure, replacing the generated failure with an identification code by identification code searching means from the table stored in the memory means, memorizing the generated failure by means for storing the identification code, searched by the searching means, in another memory means, and retaining the memorized content even after the failure is resolved.

The present invention is also featured by varying the state of a processing apparatus by at least an operation means capable of varying the state of the processing apparatus, representing the state of the processing apparatus by at least a state representing means for representing such state by an ON/OFF state, switching the represented content by these two means, converting the identification code corresponding to the generated failure by format converting means into a format representable by the state representing means, and representing the content of the failure in a form easily understandable by the user, by means which causes the state representing means to display the data converted by the converting means.

The present invention is further featured by allowing the user to survey the history of the failures generated in the past by means for operating the failure information such as the stored identification code, and to return the apparatus to the initial state by erasing such information.

The present invention is further featured by printing the record of the generated failure by means which prints the failure information such as the stored identification code.

The present invention is further featured by transmitting the information of the generated failure to a connected external equipment by means which transmits the failure information such as the stored identification code to the external equipment, thereby allowing the user to confirm the state of the failure by an equipment utilized by the user.

According to the present invention, there is provided an output control apparatus for use in an output apparatus for forming image data by analyzing an instruction received from an external equipment and outputting thus formed image data to the outside, the apparatus comprising:

memory means for memorizing, in case of a change in the state of the apparatus, an identification code corresponding to such change;

instruction means for instructing a test output for the set value information of the output apparatus; and control means for controlling the output in such a manner, in case the identification code is memorized in the memory means, as to output information corresponding to the identification code together with the set value information of the output apparatus in response to the instruction given by the instruction means.

According to the present invention, there is also provided an output control apparatus for use in an output apparatus for forming image data by analyzing an instruction received from an external equipment and outputting thus formed image data to the outside, the apparatus comprising:

memory means for memorizing, in case of a change in the state of the apparatus, an identification code corresponding to such change;

instruction means for giving various instructions, not relating to the formation of the image data, to the output apparatus; and control means for controlling the erasure of the identification code memorized in the memory means, in response to an instruction from the instruction means.

According to the present invention, there is also provided an output control method for use in an output apparatus adapted to form image data by analyzing an instruction received from an external equipment and to output thus formed image data to the outside, the method comprising:

a memory function for memorizing, in case of a change in the state of the apparatus, a corresponding identification code;

an instruction recognizing function for receiving a test output instruction for instructing the output of the set value information of the output apparatus; and a control function for controlling the output in such a manner, in case the identification code is memorized by the memory function, as to output information corresponding to the identification code together with the set value information of the output apparatus based on the instruction recognized by the instruction recognizing function.

According to the present invention, there is also provided an output control method adapted to form image data by analyzing an instruction received from an external equipment and to output thus formed image data to the outside, the method comprising:

a memory function for memorizing, in case of a change in the state of the apparatus, a corresponding identification code;

an instruction recognizing function for recognizing various instructions to an output apparatus, not relating to the formation of the image data; and a control function for controlling the erasure of the identification code memorized by the memory function, in response to the recognition of an instruction by the instruction recognizing function.

According to the present invention, there is also provided a memory medium storing a program for controlling an output apparatus adapted to form image data by analyzing an instruction received from an external equipment and to output thus formed image data to the outside, the program comprising:

a memory function for memorizing, in case of a change in the state of the apparatus, a corresponding identification code;

an instruction recognizing function for receiving a test output instruction for instructing the output of the set value information of the output apparatus; and a control function for controlling the output in such a manner, in case the identification code is memorized by the memory function, as to output information corresponding to the identification code together with the set value information of the output apparatus based on the instruction recognized by the instruction recognizing function.

According to the present invention, there is also provided a memory medium storing a program for controlling the output of an output apparatus adapted to form image data by analyzing an instruction received from an external equipment and to output thus formed image data to the outside, the program comprising:

a memory function for memorizing, in case of a change in the state of the apparatus, a corresponding identification code;

an instruction recognizing function for recognizing various instructions to the output apparatus, not relating to the formation of the image data; and a control function for controlling the erasure of the identification code memorized by the memory function, in response to the recognition of an instruction by the instruction recognizing function.

The present invention enables to correctly comprehend the status of the processing apparatus in which the operation panel or the display device is simplified for the purpose of cost reduction. It also enables to obtain detailed information of the failure within the processing apparatus only, even in case the information cannot be transmitted to the external equipment because of a malfunction in the communicating function or in case the information cannot be received by the external equipment because of a malfunction therein. Furthermore, the failures generated in the past are memorized in the apparatus regardless whether it is equipped with the operation panel, display device etc. or not, whereby the failure can be easily traced and can be promptly eliminated. It is also rendered possible to erase the information of such failure without the instruction for the erasure. According to the present invention, there can be provided an output control method, an apparatus and a recording medium adapted therefor that can attain these objectives.

BRIEF DESCRIPTION OF THE DRAWINGS

FIGS. 3 and 4 are schematic views showing the first embodiment;

DETAILED DESCRIPTION OF THE PREFERRED EMBODIMENTS

Embodiment 1

Figure 1:
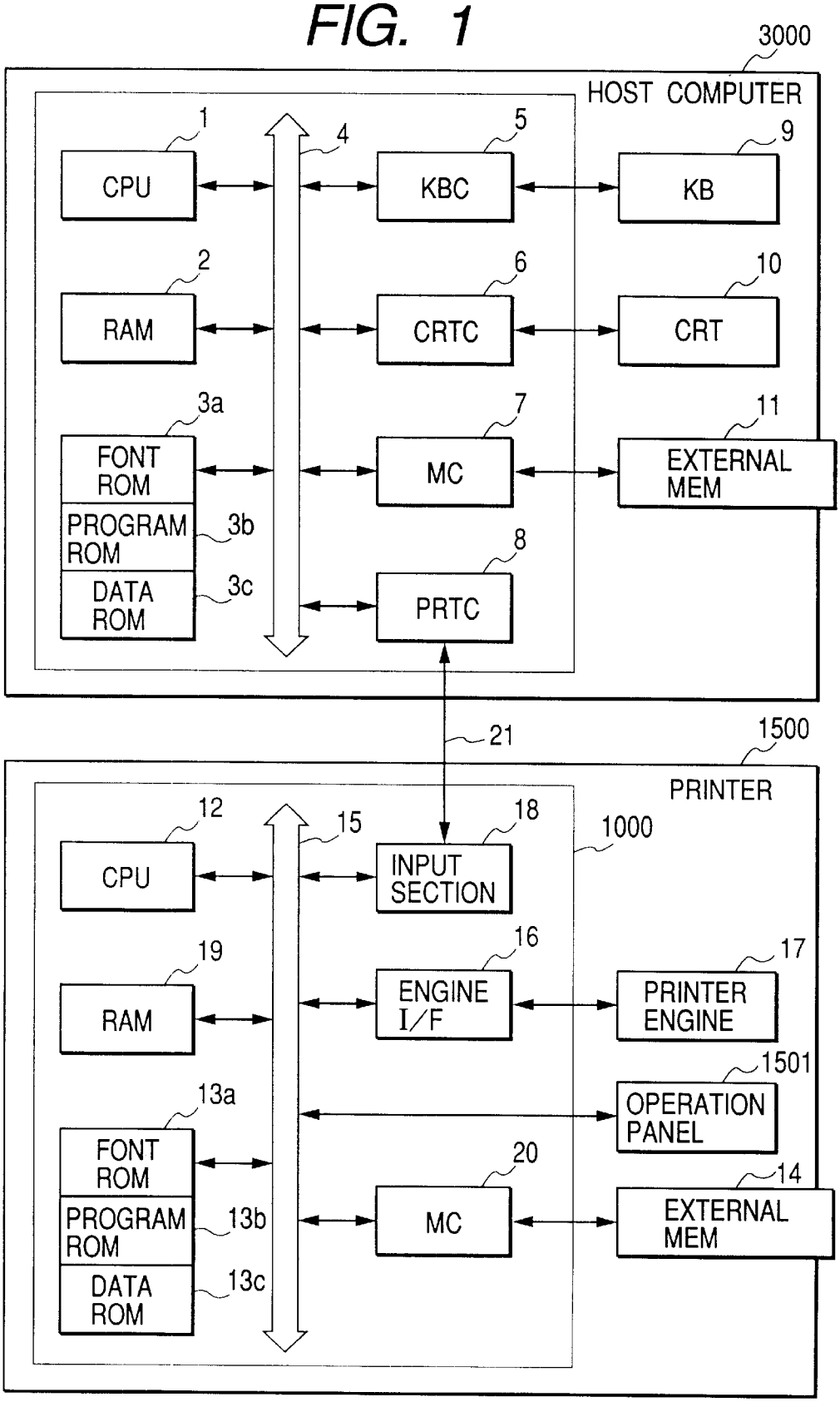
FIG. 1 is a block diagram showing the basic configuration embodying the present invention.

FIG. 1 is a block diagram showing the configuration of a printer control system, constituting an embodiment of the present invention. In the following description, a laser beam printer is taken as an example. It is to be understood that the present invention is also applicable to a single equipment, a system consisting of plural equipment or a system in which the processing is executed through a network such as LAN, as long as the functions of the present invention are attained.

Referring to FIG. 1, a host computer 3000 is provided with a CPU 1 which executes text processing including graphics, images, characters and tables (including table calculations) based on a text processing program stored in a program ROM of a ROM 3 and which collectively controls various devices connected to a system bus 4.

In the ROM 3, a program ROM 3*a* stores the control program etc. of the CPU 1, a program ROM 3*b* stores the font data etc. employed in the text processing mentioned above, and a program 3*c* stores various data employed in the text processing. A RAM 2 functions as a main memory, a work area etc. of the CPU 1. A keyboard controller (KBC) 5 controls the key input from a keyboard 9 and an unrepresented pointing device. A CRT controller (CRTC) 6 controls the display on a CRT display 10. A memory controller (MC) 7 controls access to an external memory 11 such as a hard disk (HD) or a floppy disk (FD) used for storing boot programs, applications, font data, user files, editing files etc. A printer controller (PRTC) 8 is connected with a printer main body 1500 through a bidirectional interface 21 and executes communication control with a printer control unit 1000. The CPU 1 executes rasterization of the outline font into a display information RAM defined in the RAM 2, thereby enabling WYS1WYG on the CRT 10. Also the CRT 1 opens various registered windows and executes various data processings, based on commands instructed by an unrepresented mouse cursor on the CRT 10.

Figure 5:
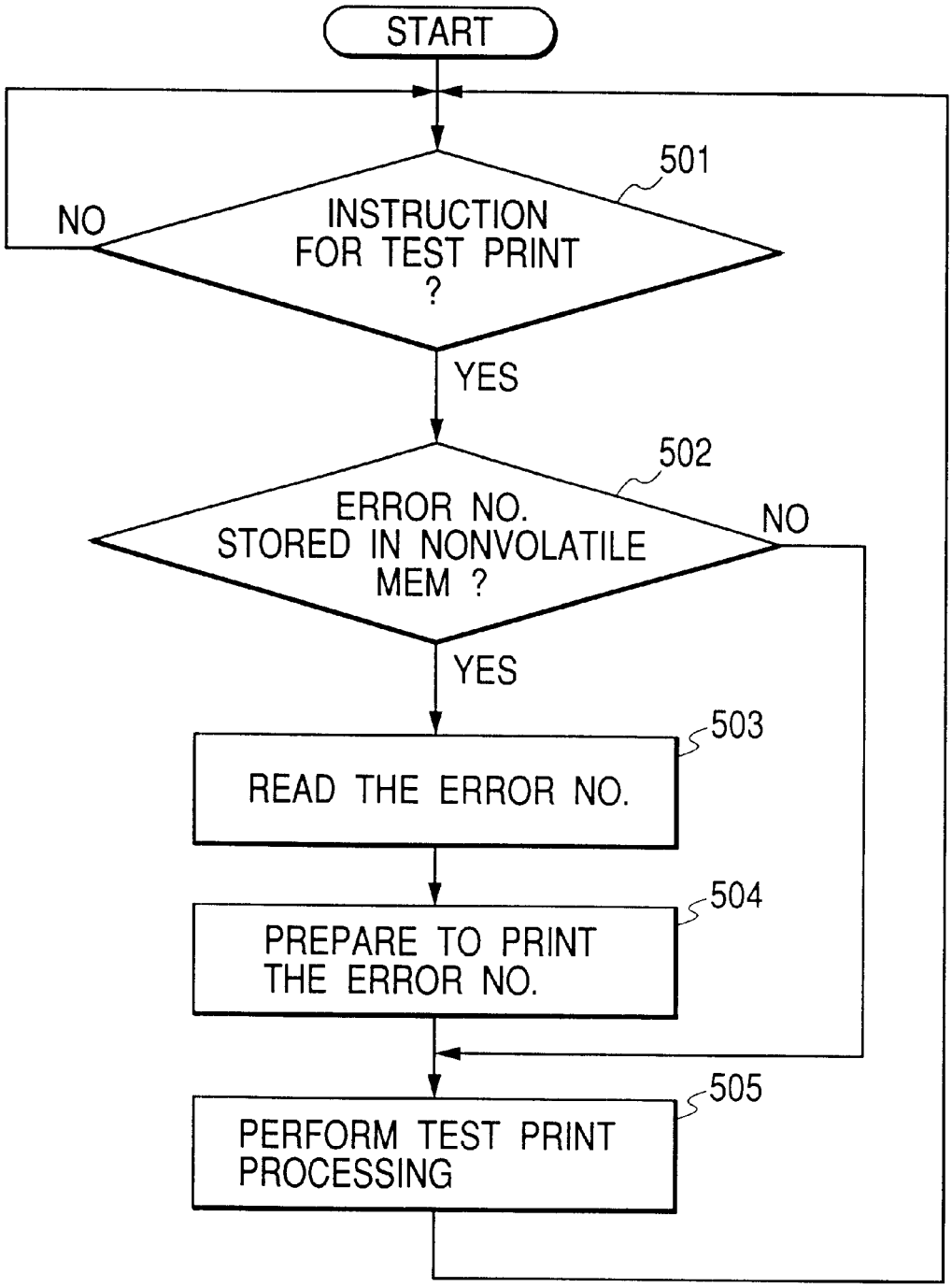
FIG. 5 is a flow chart showing the control sequence of a second embodiment.
Figure 6:
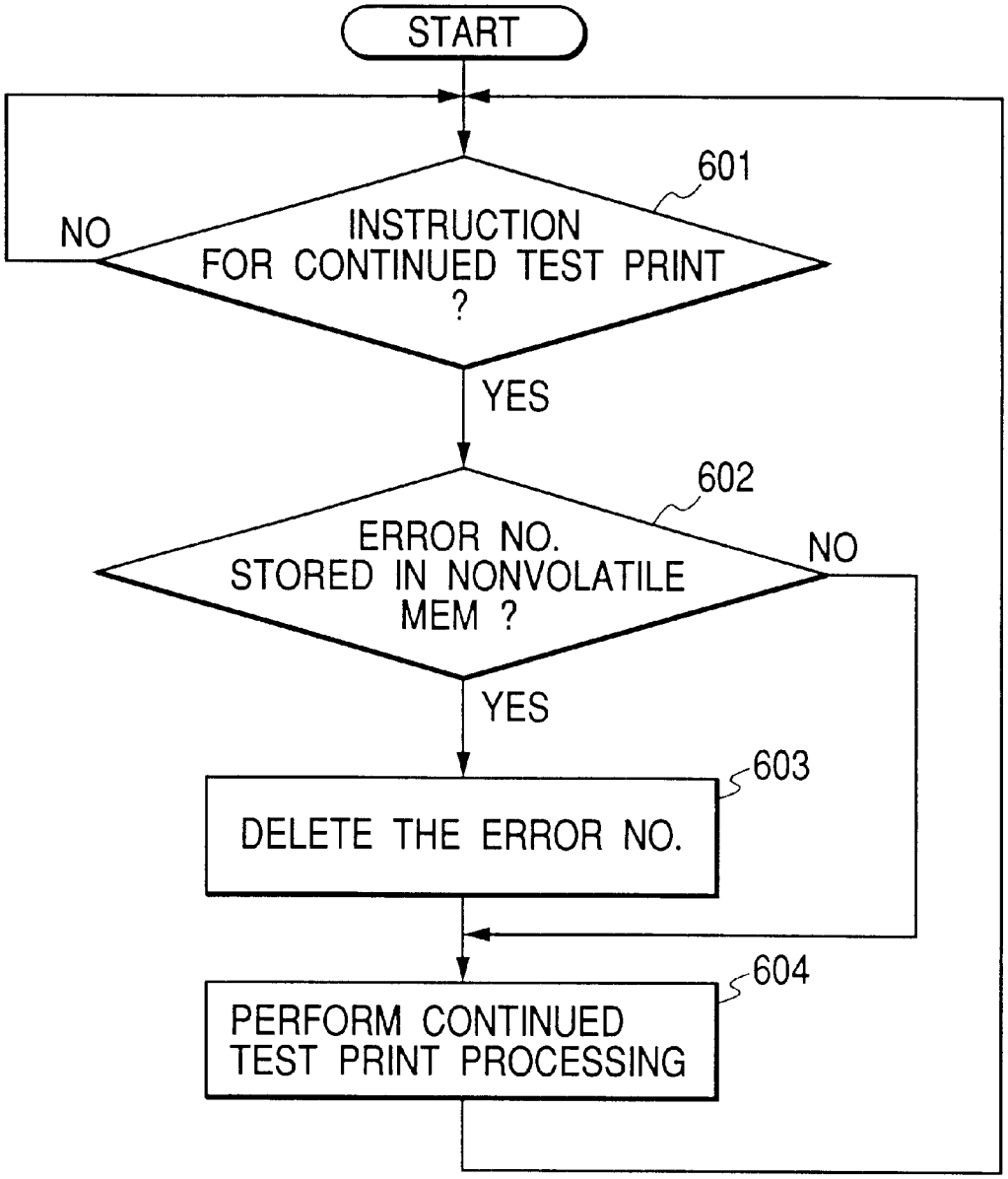
FIG. 6 is a flow chart showing the control sequence of a third embodiment.

The laser beam printer (LBP) 1500 is provided with an operation panel 1501 including operations switches, LED display units etc., and a printer control unit 1000 for controlling the entire LBP 1500 and analyzing the print information supplied from a host computer. In the printer control unit 1000, a printer CPU 12 collectively controls access to various devices connected to a system bus 15 based on a control program stored in the program ROM 13*a* of the ROM 13 or a control program stored in an external memory 14, and outputs an image signal as output information to a printing unit (printer engine) 17 connected through a printer interface 16. The program ROM 13*a* of the ROM 13 stores the control programs of the CPU 12, for example corresponding to flow charts shown in FIGS. 5 and 6. The font ROM 13*b* of the ROM 13 stores the font data to be used in the formation of the above-mentioned output information, and the data ROM 13*c* of the ROM 13 stores, for example, the information to be used in the host computer in case of a printer lacking the external memory 14 such as the hard disk. The CPU 12 is rendered capable of communication with the host computer through an input unit 18, thereby capable of transmitting the information of the printer to the host computer 3000. A RAM 19 functions as the main memory, work area etc. of the CPU 12 and is so constructed as to be expandable in memory capacity by an optional RAM to be connected to an unrepresented expansion port. The RAM 19 is used as an output information developing area, an environmental data storing area, a NVRAM etc. The aforementioned external memory 14 such as the hard disk or IC card is access controlled by a memory controller (MC) 20. The external memory 14 is connected as an option and is used for storing font data, emulation data, form data etc.

The above-mentioned external memory is not limited to one, but there may be adopted a configuration capable of accommodating also an optional font card or plural external memories storing, for example, a program for interpreting a printer control language of a different language system. Furthermore, there may be additionally provided an unrepresented NVRAM for storing printer mode setting information entered by a command from the operation panel or the host computer.

Figure 2:
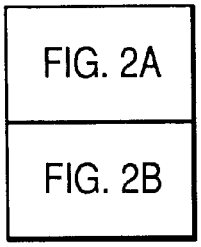
FIG. 2 which is composed of FIGS. 2A and 2B are flow charts showing the control sequence of a first embodiment.
Figure 2A:
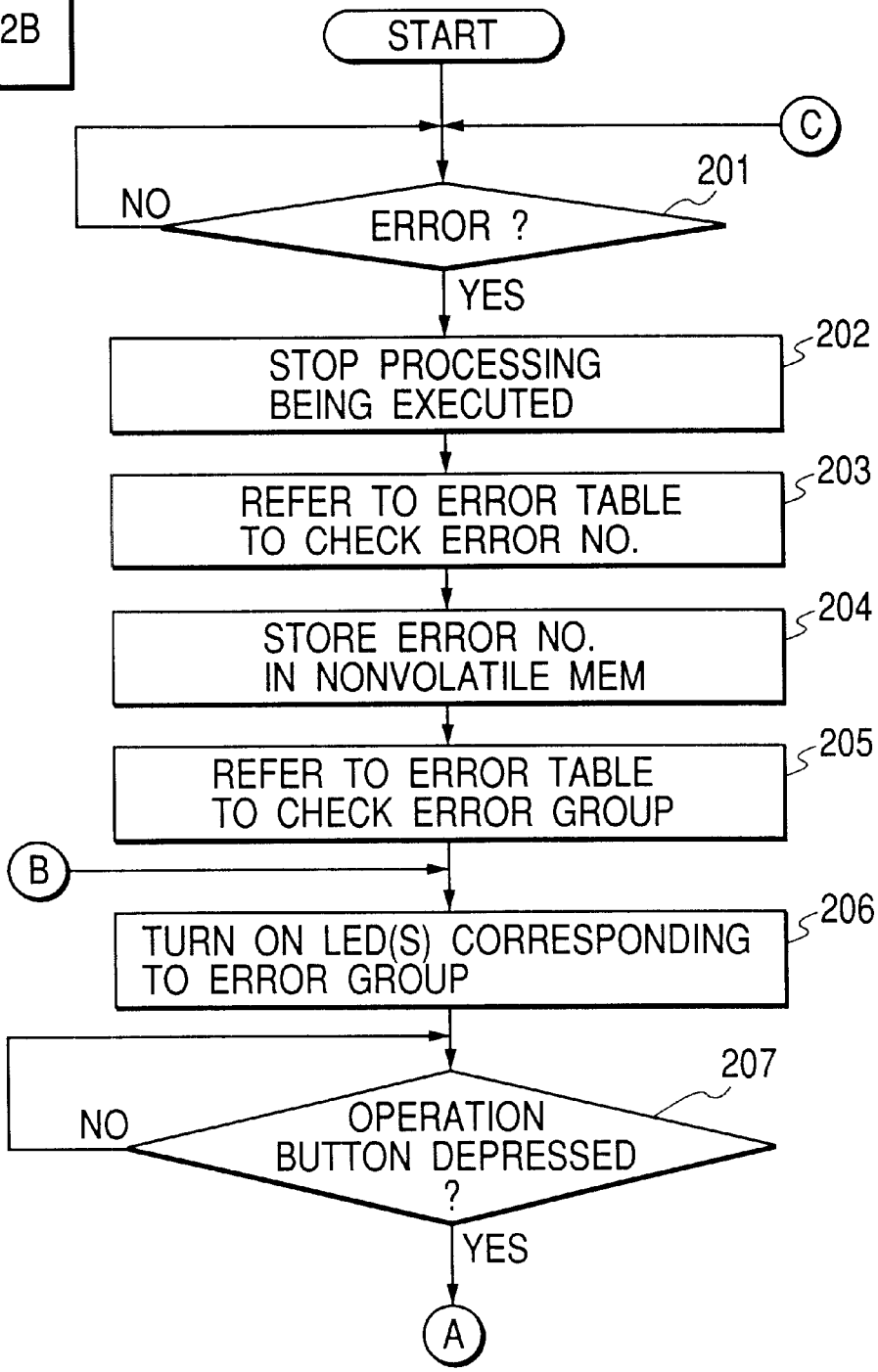
Figure 2B:
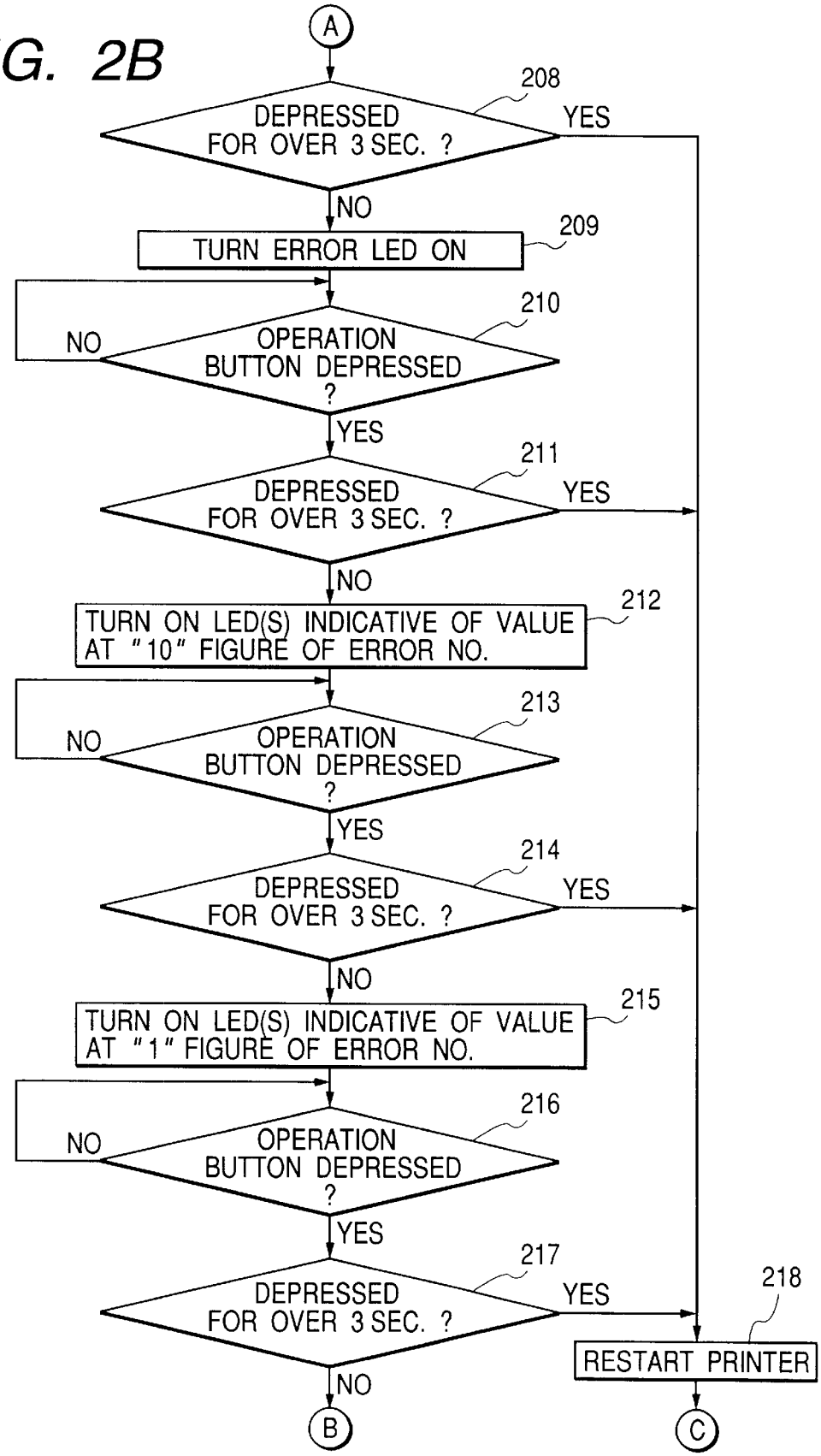

In the following there will be explained, with reference to flow charts shown in FIGS. 2A and 2B, the control sequence of the above-explained printer control system of the present embodiment.

Figure 3:
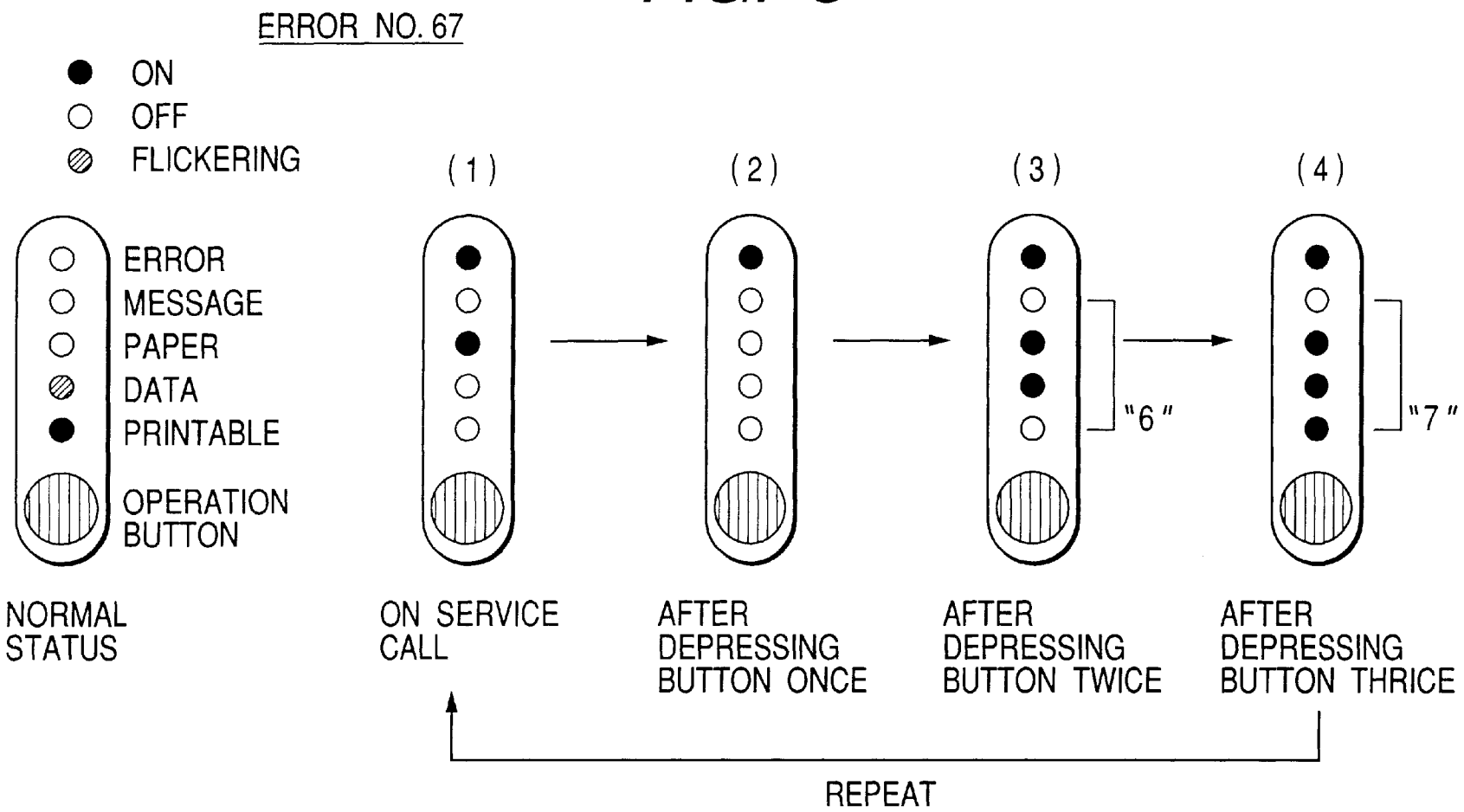

At first a step 201 discriminates whether an error has been generated. The sequence of the present embodiment is initiated in case a failure is generated regardless whether the printer is in the stand-by state or in the course of data reception. In case of a failure, the operation currently in progress is interrupted. For example, if a failure occurs in the course of initialization at the start of power supply, the initialization process is interrupted. Also if the print data are being processed, such process is interrupted (step 202). Then a number, corresponding to the content of the generated failure, is searched by referring to a table prepared in advance (step 203). As shown in FIG. 4, this table stores the correspondence of the state of the generated error, the error number, the classification of the error and the LED's to be turned on, and is stored in the program ROM 13*b* or the data ROM 13*c* shown in FIG. 1. It is also possible to store such table in the RAM 19 by downloading from the outside. In the present embodiment, there will be explained a case that a failure is generated in the RAM 19 shown in FIG. 1 in the course of processing of the print data, such as the case of a contradiction, in the link structure, resulting from an error in the address indicating the head address of a succeeding block. Such failure corresponds to an error number 67 in the table shown in FIG. 4. This number is memorized in the non-volatile memory (step 204). Such non-volatile memory is not shown in FIG. 1 but constitutes a part of the RAM 19. Then the table shown in FIG. 4 is referred to for searching a group to which the generated failure belongs (step 205). Since the individual error numbers cannot be represented by a limited number of LED's, a certain number of failures are grouped and represented by an LED. Then corresponding LED's are turned on (step 206). In case of the error number 67, an "error LED" and a "paper LED" are to be turned on according to the table shown in FIG. 4. For the errors with numbers from 50 to 5F, an "error LED" and "data LED" are turned on. Though the table shown in FIG. 4 illustrates only a part of the errors as an example, other errors are grouped in a similar manner to obtain groups each consisting of similar failures and the LED's to be turned on are assigned to each of such groups. FIG. 3 shows an example of a printer equipped with an operation button and five LED's in a state of an error of the error number 67. An ordinary state indicates a state in which the print data have been received and are being processed and in which a "printable LED" is turned on and a "paper LED" flickers. If the error of the error number 67 occurs in the course of this process, the "error LED" and the "paper LED" are turned on as indicated by (1), corresponding to a step 206 in FIG. 2A. If the button is depressed for a period not exceeding 3 seconds in this state (steps 207, 208), the "error LED" alone is turned on while other LED's are turned off (step 209) as indicated by (2) in FIG. 3. This display is given in order to clarify the state of transition of the error display. Then, as in the steps 207, 208, whether the button has been depressed is discriminated, and the depressed time does not exceed 3 seconds (steps 210, 211), and, if the button has been depressed for a period not exceeding 3 seconds, the turned-on LED is changed in order to indicate the first-digit value of the error number (step 212). In the present embodiment, the error numbers are represented by two-digit hexadecimal numbers, and each digit is represented by four LED's in which a bit corresponds to an LED. A "message LED" represents the most significant bit while the "printable LED" represents the least significant bit. The "error LED" continues to be turned on in order to indicate the error state. In the illustrated example, since the error number is 67, LED's indicating "6" (hexadecimal) are made to flicker. In FIG. 3, a state (3) indicates that the first digit of the error number is "6". Then there are discriminated, as in the steps 207, 208, whether the button has been depressed and the depressed time does not exceed 3 seconds (steps 213, 214), and, if the button has been depressed for a period not exceeding 3 seconds, the turned-on LED is changed in order to indicate the second-digit value of the error number (step 215). In the illustrated example, since the error number is 67, LED's indicating "7" (hexadecimal) are turned on. In FIG. 3, a state (4) indicates that the first digit of the error number is "7". Then there are discriminated, as in the steps 207, 208, whether the button has been depressed and the depressed time does not exceed 3 seconds (steps 216, 217), and, if the button has been depressed for a period not exceeding 3 seconds, the sequence returns to the step 206 to repeat the above-described procedure. Referring to FIG. 3, the state returns from (4) to (1), and the states (1) - (4) are repeated thereafter. In case the step 207, 210, 213 or 216 identifies that the button has not been depressed, the state of the LED's is not changed. Also if the step 208, 211, 214 or 217 identifies that the button has been depressed in excess of 3 seconds, the sequence shifts to a process of re-starting the printer for restoration from the error state (step 218). Referring to FIG. 3, if the button is depressed for a period in excess of 3 seconds in each of the states (1) - (4), the printer gets out of the error display mode and enters a printer restarting process.

Embodiment 2

This embodiment is directed to printing the recent errors on a test print. The control sequence of the present embodiment will be explained with reference to FIG. 5. It is assumed that the printer is in a stand-by state. Initially, a discrimination is made as to whether a test printing is instructed by a command supplied from the operation button or from the outside (step 501). The test printing means a function of printing, on a sheet, a list of currently set values of presettable items of the printer such as the program version, the installed fonts and the sheet size, and font samples. The test printing mode can be assumed, for example, by depressing the operation button shown in FIG. 3 for over 3 seconds. If the button is depressed for another period exceeding 3 seconds, there is instructed a continuous test printing to be explained later. If the step 501 identifies the absence of the instruction for test printing, the printer enters a stand-by state until any instruction is given. If the step 501 identifies the presence of the instruction for test printing, a check is made as to whether an error number is memorized in the non-volatile memory (step 502). As explained in the foregoing embodiment, the non-volatile memory memorizes the numbers of the recent errors. If the error number is memorized in the non-volatile memory, it is read out (step 503). Then there is executed a process of printing the error number in a predetermined position (step 504). Thereafter there is executed an ordinary test printing process on the sheet (step 505). If the step 502 identifies the absence of the memorized error number, the sequence proceeds to the step 505 to execute the ordinary test printing process, namely test printing without the printing of the error number, on the sheet.

Figure 7:
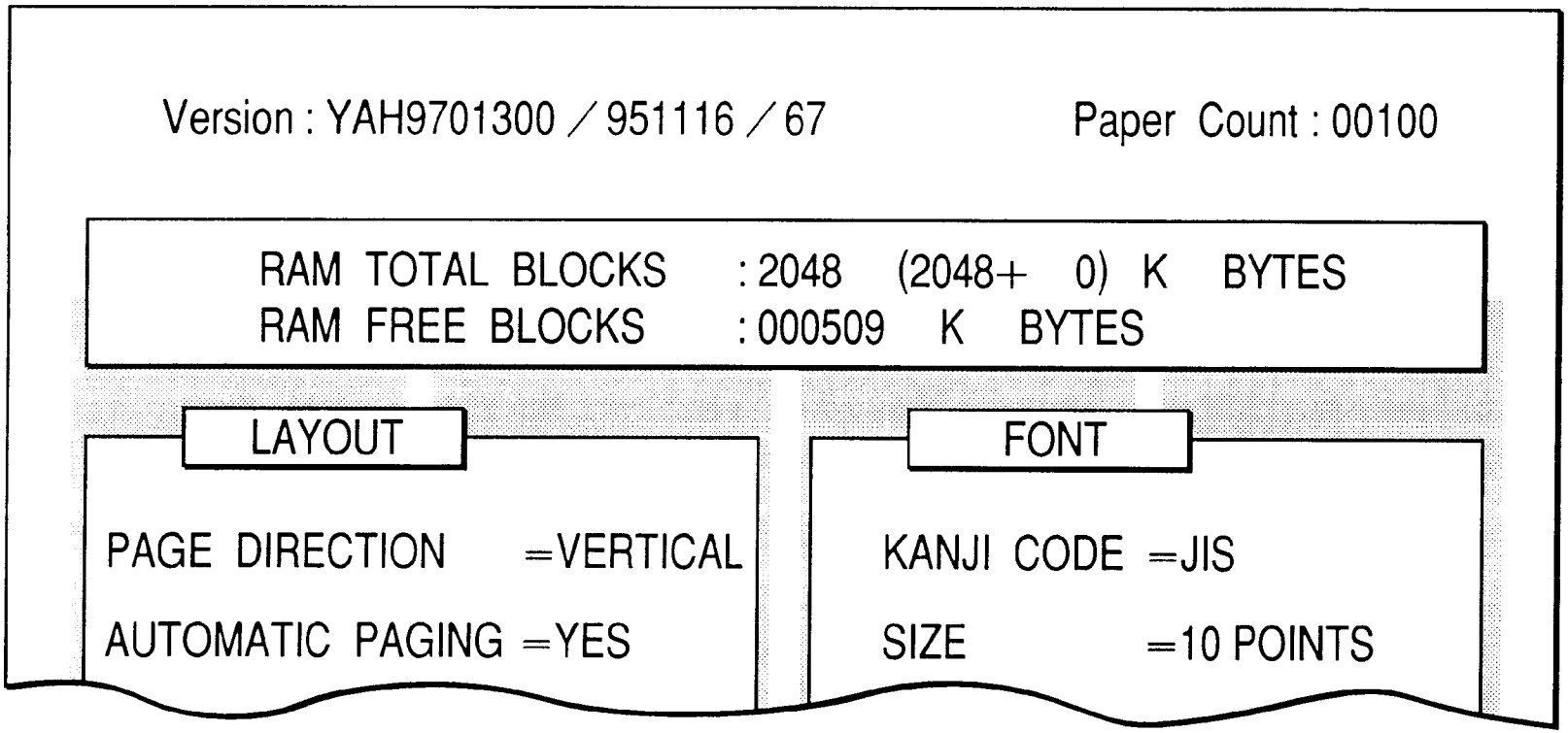
FIG. 7 is a schematic view showing the second embodiment.

FIG. 7 shows a part of an example of the test print, including an error number. In the version column, there is printed a program version, followed by a font ROM version after a mark "/" and an error number 67 again after a mark "/". The error number is always printed on the test print until the error number memorized in the non-volatile memory is erased by a certain operation. Instead of the printing of the error number, it may be converted and printed in a test explaining such error.

Embodiment 3

This embodiment shows a configuration of erasing the error number memorized in the non-volatile memory, by a certain operation. In the present embodiment, the erasure of the error number memorized in the non-volatile memory is triggered by a printing instruction, which is not too frequently used by the user. For example the error number is erased from the non-volatile memory by the instruction for a continuous test printing. The erasure may also be triggered by other various instructions such as the instruction for test printing or that for NVRAM initialization, but, since these instructions are relatively frequently used by the user, the present embodiment utilizes the continuous test printing instruction as the trigger. However such selection is naturally not restrictive. The continuous test printing means a function of continuously outputting an output sample (such as a list of fonts, description of the features of the printer etc.) stored in advance in the program ROM 13*b* of the printer. Now the control sequence of the present embodiment will be explained with reference to FIG. 6. It is assumed that the printer is in the stand-by state. Initially, a discrimination is made as to whether the continuous test printing has been instructed by a command from the operation button or from the outside (step 601). If the continuous test printing is instructed, there is checked whether an error number is memorized in the non-volatile memory (step 602). If the error number is memorized in the non-volatile memory, such error number is erased (step 603). Then there is executed a process of continuous test printing on the sheet (step 604). If the step 602 identifies the absence of the error number in the non-volatile memory, the sequence proceeds to a step 604 to execute the continuous test printing process. If the test printing is executed after the execution of the continuous test printing, the error number printed in the version column is no longer printed as shown in FIG. 7. Thus the error number is not printed until an error is newly generated and the corresponding error number is memorized in the non-volatile memory.

Embodiment 4

In the first embodiment, the error number is obtained by the operation button and the LED's of the printer main body, but it may instead be returned, at the generation of an error, from the printer to the host equipment through the bidirectional interface. Otherwise these two forms may be adopted simultaneously.

Embodiment 5

In the second embodiment, the error number is obtained by the execution of the test printing, but it may instead be returned from the printer to the host equipment through the bidirectional interface when requested from the host equipment. Otherwise the error number may be informed by voice.

Embodiment 6

In the third embodiment, the error number memorized in the non-volatile memory is erased at the execution of the continuous test printing, but such form is not restrictive. For example, the erasure may be executed by the issuance of an erasing command from the outside.

Embodiment 7

The first embodiment memorizes the error number of the most recently generated error alone, but it is also possible to memorize the error number and the date thereof in a consecutive manner in order to clarify the history of the generated errors. The memory means can be a non-volatile memory as in the first embodiment, or may also be an internal RAM, an external memory, or a RAM or a hard disk connected to an external equipment through a bidirectional communication interface. Also there may be memorized, in addition to the date, information associated with the error such as the file name of the data transmitted to the printer, the name of the host equipment which has transmitted the data, the environmental set values of the printer and the host equipment at the generation of the error. It is furthermore possible to sort or search the memorized information according to arbitrary conditions and to print the result or to transmit the same to an external equipment through the bidirectional communication interface.

Embodiment 8

The foregoing embodiments are to inform the user of the status of the failure, but the present invention is applicable not only to such information of the failure but naturally also to any information indicating the state of the processing apparatus. In the following there will be explained the structure of the printer in which the present invention is applicable.

Figure 8:
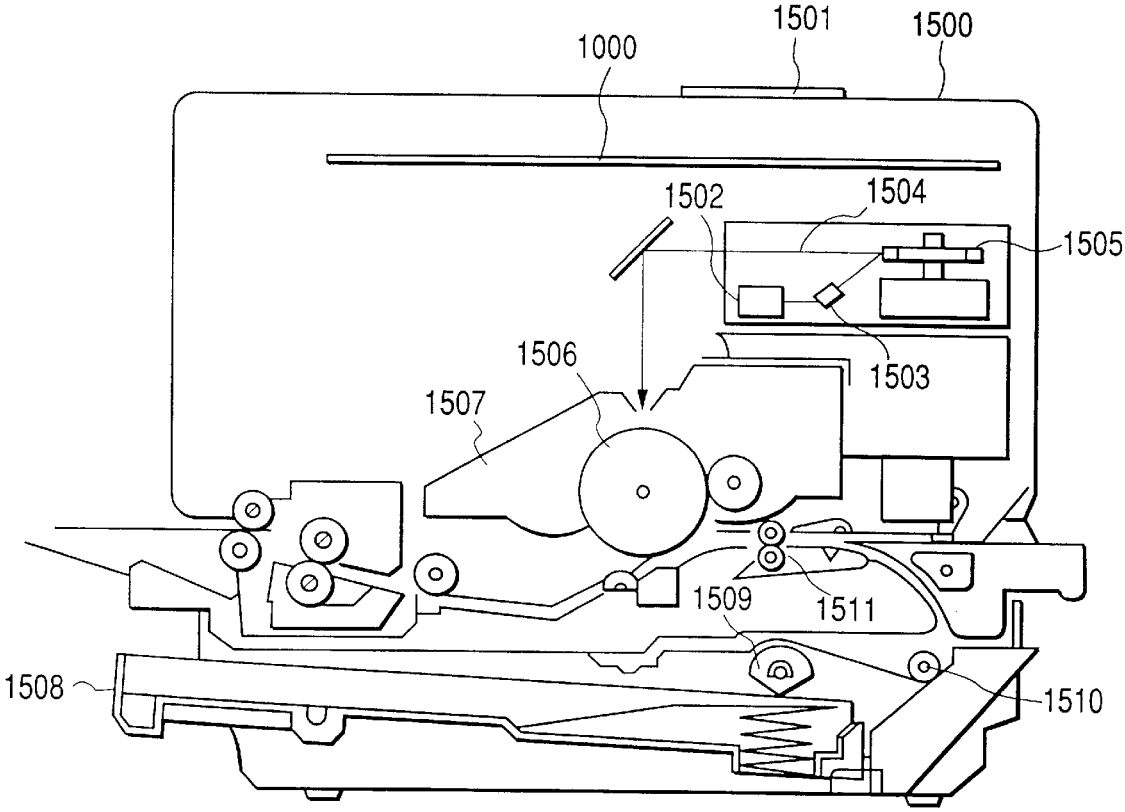
FIGS. 8 and 9 are views showing the configuration of a printer.
Figure 9:
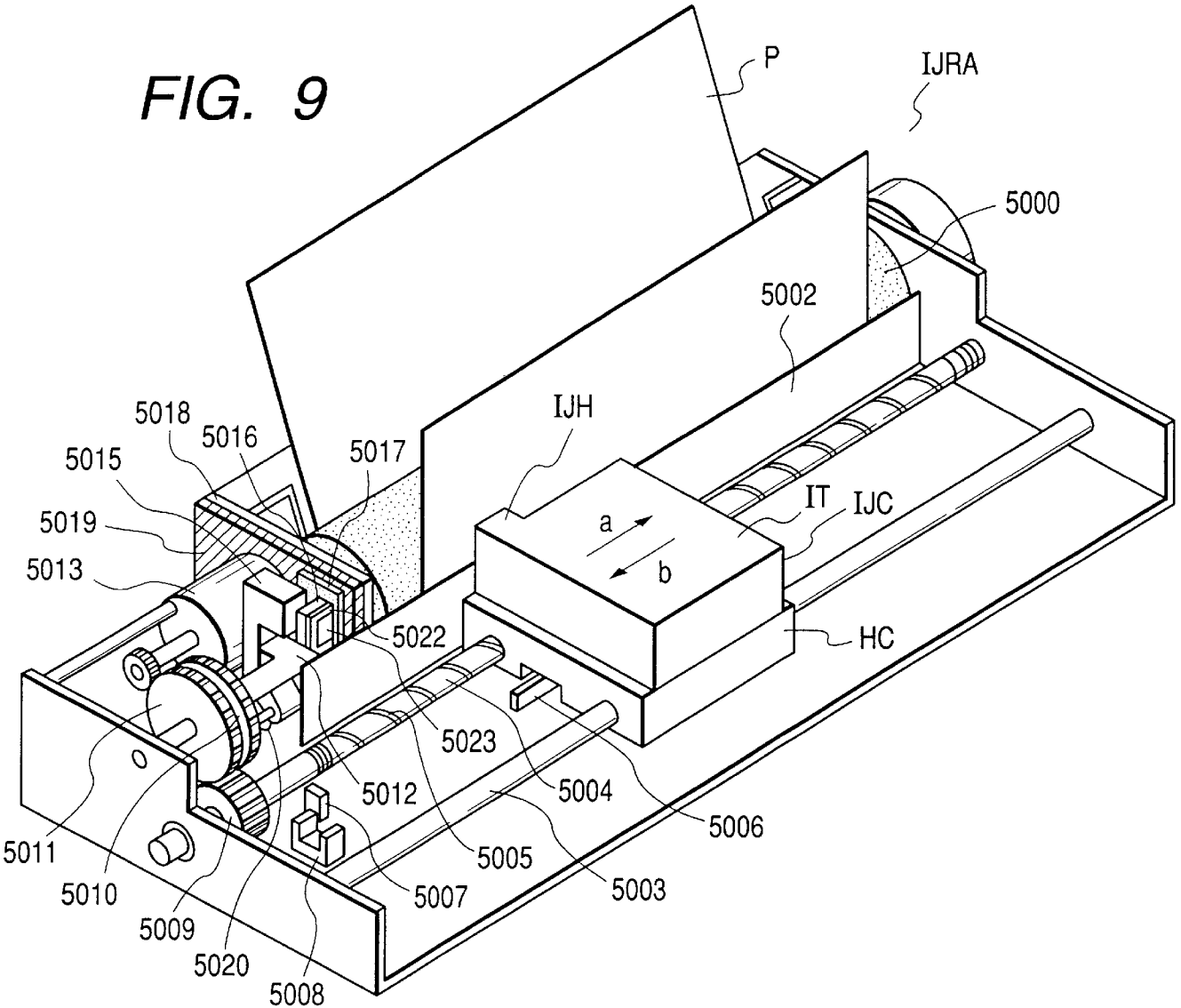

Now reference is made to FIGS. 8 and 9 for explaining the structure of a laser beam printer and an ink jet printer in which the present invention is applicable. However, the present invention is applicable not only to such laser beam printer or ink jet printer but naturally also to any other printer.

FIG. 8 is a cross-sectional view showing the configuration of a laser beam printer (LBP) constituting the first recording apparatus in which the present invention is applicable.

Referring to FIG. 8 an LBP (printer 1500) receives and stores print information (character codes etc.), form information and macroinstructions from an externally connected host computer, prepares a character pattern or a form pattern according to such information and forms an image on a recording sheet constituting the recording medium. There are provided an operation panel 1501 equipped with operation switches and LED display devices, and a printer control unit 1000 for controlling the entire LBP 1500 and analyzing the character information etc. supplied from the host computer. The printer control unit 1000 principally converts the character information into a video signal of corresponding character patterns, for supply to a laser driver 1502, which drives a semiconductor laser 1503 and executes on-off control of the laser light 1504 emitted therefrom. The laser light 1504 is deflected by a rotary polygon mirror 1505 in the lateral direction to scan an electrostatic drum 1506, whereby an electrostatic latent image of the character pattern is formed thereon. The latent image is developed by a developing unit 1507 provided around the electrostatic drum 1506 and is transferred onto a recording sheet. The recording sheet is composed of a cut sheet, which is contained in a sheet cassette 1508 mounted on the LBP 1500, fetched into the apparatus by a sheet feeding roller 1509 and transporting rollers 1510, 1511 and is supplied to the electrostatic drum 1506.

FIG. 9 is an external view of an ink jet recording apparatus (IJRA) constituting the second recording apparatus in which the present invention is applicable.

Referring to FIG. 9, a carriage HC, engaging with a spiral groove 5004 of a lead screw 5005 which is rotated by the forward or reverse rotation of a driving motor 5013 through transmission gears 5009, 5011, is provided with a pin (not shown) and is reciprocated in directions a and b along a guide rail 5003. The carriage HC supports an ink jet cartridge IJC provided with an ink tank IT and an ink jet head IJH. A paper support plate 5002 presses the recording sheet toward a platen 5000, over the moving range of the carriage.

Photocouplers 5007, 5008 serve as home position detecting means for confirming the presence of a lever 5006 of the carriage in the corresponding area and switching the rotating direction of the driving motor 5013. There are also provided a member 5016 supporting a capping member 5022 for capping the entire face of the recording head; suction means 5015 for sucking the interior of the capping member through an aperture 5023 in the cap thereby executing suction recovery of the recording head; a cleaning blade 5017 rendered movable front and back by a member 5019; a supporting plate 5018 of the main body, supporting the cleaning blade 5017 and the member 5019; and a lever 5012 which initiates the suction for suction recovery operation and which is moved by a cam 5020 engaging with the carriage and driven by the driving motor 5013 through known transmission means such as a clutch.

The capping operation, the cleaning operation and the suction recovery operation are executed in respective positions by the function of the lead screw 5005 when the carriage is moved to the area of the home position, but there may be assumed any configuration as long as the desired operations are executed at the known timings.

As explained in the foregoing, the present invention allows to provide an apparatus which is featured by detecting a failure generated in the apparatus by failure detecting means, assigning, to the generated failure, an identification code for identifying the kind of the failure by identification code assigning means, memorizing a table correlating the content of the failure with the identification code by means for memorizing the assignment by the assigning means, replacing, at the generation of a failure, the generated failure with the identification code by means which searches the identification code corresponding to the generated failure among those memorized in the memory means, memorizing the generated failure by means which stores the identification code, searched by the searching means, in another memory means, and retaining the memorized content even after the failure is resolved.

Also there can be provided an apparatus which is featured by varying the state of the processing apparatus by at least operating means capable of varying the state of the processing apparatus, representing the state of the processing apparatus by at least one state representing means which represents the state of the processing apparatus by on/off states, switching the represented content by the foregoing two means, converting the identification code corresponding to the generated failure by format converting means into a format that can be represented by the state representing means, and representing the content of the failure in a form easily understandable by the user by means which causes the data converted by the converting means to be represented by the state representing means.

The present invention is further featured by allowing to survey the history of the failures generated in the past by means for operating the failure information such as the stored identification code, and restoring the initial state by erasing such information.

The present invention is further featured by printing the record of the information of the generated failure, by means which prints the failure information such as the stored identification code.

The present invention is further featured by transmitting the information of the generated failure such as the stored identification code to a connected external equipment by failure information transmitting means, thereby enabling the user to confirm the state of the failure on the equipment used by the user.

According to the present invention, there is also provided an output control apparatus for use in an output apparatus adapted to form image data by analyzing an instruction received from an external equipment and to output thus formed image data to the outside, the apparatus comprising:

memory means for memorizing, in case of a change in the state of the apparatus, an identification code corresponding to such change;

instruction means for instructing a test output for the set value information of the output apparatus; and control means for controlling the output in such a manner, in case the identification code is memorized in the memory means, as to output information corresponding to the identification code together with the set value information of the output apparatus in response to the instruction given by the instruction means.

According to the present invention, there is also provided an output control apparatus for use in an output apparatus adapted to form image data by analyzing an instruction received from an external equipment and to output thus formed image data to the outside, the apparatus comprising:

memory means for memorizing, in case of a change in the state of the apparatus, an identification code corresponding to such change;

instruction means for giving various instructions, not relating to the formation of the image data, to the output apparatus; and control means for controlling the erasure of the identification code memorized in the memory means, in response to an instruction from the instruction means.

According to the present invention, there is also provided an output control method for use in an output apparatus adapted to form image data by analyzing an instruction received from an external equipment and to output thus formed image data to the outside, the method comprising:

a memory function for memorizing, in case of a change in the state of the apparatus, a corresponding identification code;

an instruction recognizing function for receiving a test output instruction for instructing the output of the set value information of the output apparatus; and a control function for controlling the output in such a manner, in case the identification code is memorized by the memory function, as to output information corresponding to the identification code together with the set value information of the output apparatus based on the instruction recognized by the instruction recognizing function.

According to the present invention, there is also provided an output control method adapted to form image data by analyzing an instruction received from an external equipment and to output thus formed image data to the outside, the method comprising:

a memory function for memorizing, in case of a change in the state of the apparatus, a corresponding identification code;

an instruction recognizing function for recognizing various instructions to an output apparatus, not relating to the formation of the image data; and a control function for controlling the erasure of the identification code memorized by the memory function, in response to the recognition of an instruction by the instruction recognizing function.

According to the present invention, there is also provided a memory medium storing a program for controlling an output apparatus adapted to form image data by analyzing an instruction received from an external equipment and to output thus formed image data to the outside, the program comprising:

a memory function for memorizing, in case of a change in the state of the apparatus, a corresponding identification code;

an instruction recognizing function for receiving a test output instruction for instructing the output of the set value information of the output apparatus; and a control function for controlling the output in such a manner, in case the identification code is memorized by the memory function, as to output information corresponding to the identification code together with the set value information of the output apparatus based on the instruction recognized by the instruction recognizing function.

According to the present invention, there is also provided a memory medium storing a program for controlling the output of an output apparatus adapted to form image data by analyzing an instruction received from an external equipment and to output thus formed image data to the outside, the program comprising:

a memory function for memorizing, in case of a change in the state of the apparatus, a corresponding identification code;

an instruction recognizing function for recognizing various instructions to the output apparatus, not relating to the formation of the image data; and a control function for controlling the erasure of the identification code memorized by the memory function, in response to the recognition of an instruction by the instruction recognizing function.

As explained in the foregoing, the present invention enables to correctly comprehend the status of the processing apparatus in which the operation panel or the display device is simplified for the purpose of cost reduction. It also enables to obtain detailed information of the failure within the processing apparatus only, even in case the information cannot be transmitted to the external equipment because of a malfunction in the communicating function or in case the information cannot be received by the external equipment because of a malfunction therein. Furthermore, the failures generated in the past are memorized in the apparatus regardless whether it is equipped with the operation panel, display device etc. or not, whereby the failure can be easily traced and can be promptly eliminated. It is also rendered possible to erase the information of such failure without the instruction for the erasure. According to the present invention, there can be provided an output control method, an apparatus and a recording medium adapted therefor that can attain these objectives.

What is claimed is:

1. An output control apparatus provided in an output apparatus which analyzes a command received from an external apparatus to form image data and outputs the formed image data, said output control apparatus comprising:

memory means for, in response to a change in the status of said output control apparatus, storing an identification code corresponding to the status change;

instruction means for giving a command that does not relate to formation of image data to the output apparatus, the command including a command for a continued test print; and control means for, in response to said instruction means giving the command, controlling said memory means to erase the identification code.

2. An output control apparatus according to claim 1, further comprising:

detection means for detecting an instruction for a test print; and output control means for controlling an output process such that information corresponding to the identification code stored in said memory means is output together with set value information of the output apparatus, if said detection means detects the test print instruction.

3. An output control apparatus according to claim 2, further comprising discrimination means for discriminating whether the identification code is stored in said memory means if said detection means detects the test print instruction, wherein said output control means controls the output process such that the information corresponding to the identification code is output together with said set value information, if said discrimination means discriminates that the identification code is stored in said memory means.

4. An output control apparatus according to claim 1, wherein the command includes a command entered via an operation button provided on the output apparatus or a command received from the external apparatus.

5. An output control apparatus according to claim 1, wherein the output apparatus is an ink jet printer or a laser beam printer.

6. An output control apparatus provided in an output apparatus which analyzes a command received from an external apparatus to form image data and outputs the formed image data, said output control apparatus comprising:

error detection means for detecting an error;

code assigning means for assigning an identification code to the error detected by said error detection means;

search means for searching for a code group that includes the identification code assigned by said code assigning means; and display control means for controlling a display unit to display information corresponding to the code group searched by said search means, wherein said display control means controls the display unit such that the assigned identification code is divided and displayed in addition to display of the searched code group.

7. An output control apparatus according to claim 6, wherein said display control means controls the display unit such that the assigned identification code is divided and displayed in addition to display of the searched code group, in response to an instruction given by depressing an operation button.

8. An output control apparatus according to claim 6, further comprising restart means for executing a restart process in response to an instruction given by depressing an operation button over a predetermined time.

9. An output control apparatus according to claim 6, wherein the display unit is capable of being switched between an ON state and an OFF state and said display control means controls the display unit such that the assigned identification code is divided and displayed in addition to display of the searched code group by means of the ON state or the OFF state of the display unit.

10. An output control apparatus according to claim 6, further comprising table means for storing a plurality of identification codes divided into code groups, wherein said search means searches for the code group that includes the identification code assigned by said code assigning means by referring to said table means.

11. An output control apparatus according to claim 10, wherein the display unit comprises a plurality of LEDs.

12. An output control apparatus according to claim 11, wherein said memory means stores (a) information on a combination of the LEDs to be placed in the on state for each of the code groups and (b) an identification number for each identification code, and said display control means controls the LEDs to display respective digits of the identification number.

13. An output control apparatus according to claim 10, wherein an identification code for a fixer failure and an identification code for a polygon motor failure are included in a same one of the code groups.

14. An output control apparatus according to claim 6, wherein the output apparatus is an ink jet printer or a laser beam printer.

15. An output control apparatus provided in an output apparatus which analyzes a command received from an external apparatus to form image data and outputs the formed image data, said output control apparatus comprising:

error detection means for detecting an error;

error specifying means for specifying classification of the error detected by said error detection means;

output control means for controlling an output unit to output information indicative of the error detected by said error detection means, wherein said control means further controls the output unit to output the error classification specified by said specifying means; and switch control means for controlling switching between output of the information indicative of the detected error and output of the specified error classification in response to input of a predetermined instruction.

16. An output control method carried out in an output apparatus which analyzes a command received from an external apparatus to form image data and outputs the formed image data, said output control method comprising:

a storing step, of, in response to a change in the status of the output apparatus, storing an identification code corresponding to the status change in a memory;

an instruction step, of giving a command that does not relate to formation of image data to the output apparatus, the command including a command for a continued test print; and a control step, of, in response to said instruction step giving the command, controlling the memory to erase the identification code stored in said storing step.

17. An output control method according to claim 16, further comprising:

a detection step, of detecting an instruction for a test print; and an output control step, of controlling an output process such that information corresponding to the identification code stored in said storing step is output together with set value information of the output apparatus, if said detection step detects the test print instruction.

18. An output control method according to claim 17, further comprising a discrimination step, of discriminating whether the identification code is stored in the memory if said detection step detects the test print instruction, wherein said output control step controls the output process such that the information corresponding to the identification code is output together with said set value information, if said discrimination step discriminates that the identification code is stored in the memory.

19. An output control method according to claim 16, wherein the command includes a command entered via an operation button provided on the output apparatus or a command received from the external apparatus.

20. An output control method according to claim 16, wherein the output apparatus is an ink jet printer or a laser beam printer.

21. An output control method carried out in an output apparatus which analyzes a command received from an external apparatus to form image data and outputs the formed image data, said output control method comprising:

an error detection step, of detecting an error in the output apparatus;

a code assigning step, of assigning an identification code to the error detected in said error detection step;

a search step, of searching for a code group that includes the identification code assigned in said code assigning step; and a display control step, of controlling a display unit to display information corresponding to the code group searched in said search step, wherein said display control step controls the display unit such that the assigned identification code is divided and displayed in addition to display of the searched code group.

22. An output control method according to claim 21, wherein said display control step controls the display unit such that the assigned identification code is divided and displayed in addition to display of the searched code group, in response to an instruction given by depressing an operation button.

23. An output control method according to claim 21, further comprising a restart step, of executing a restart process in response to an instruction given by depressing an operation button over a predetermined time.

24. An output control method according to claim 21, wherein the display unit is capable of being switched between an ON state and an OFF state and said display control step controls the display unit such that the assigned identification code is divided and displayed in addition to display of the searched code group by means of the ON state or the OFF state of the display unit.

25. An output control method according to claim 21, wherein the output apparatus includes a table for storing a plurality of identification codes divided into code groups, and wherein said search step searches for the code group that includes the assigned identification code by referring to the table.

26. An output control method according to claim 25, wherein the display unit comprises a plurality of LEDs.

27. An output control method according to claim 26, wherein the memory stores (a) information on a combination of the LEDs to be placed in the ON state for each of the code groups and (b) an identification number for each identification code, and said display control step controls the LEDs to display respective digits of the identification number.

28. An output control method according to claim 25, wherein an identification code for a fixer failure and an identification code for a polygon motor failure are included in a same one of the code groups.

29. An output control method according to claim 21, wherein the output apparatus is an ink jet printer or a laser beam printer.

30. An output control method carried out in an output apparatus which analyzes a command received from an external apparatus to form image data and outputs the formed image data, said output control method comprising:

an error detection step, of detecting an error in the output apparatus;

an error specifying step, of specifying classification of the error detected in said error detection step;

an output control step, of controlling an output unit to output information indicative of the error detected in said error detection step, wherein said control step further controls the output unit to output the error classification specified in said error specifying step; and a switch control step, of controlling switching between output of the information indicative of the detected error and output of the specified error classification in response to input of a predetermined instruction.

31. A computer program which executes an output control in an output apparatus which analyzes a command received from an external apparatus to form image data and outputs the formed image data, said program comprising:

code for a storing step, of, in response to a change in the status of the output apparatus, storing an identification code corresponding to the status change in a memory;

code for an instruction step, of giving a command that does not relate to formation of image data to the output apparatus, the command including a command for a continued test print; and code for a control step, of, in response to said instruction step giving the command, controlling the memory to erase the identification code stored in said storing step.

32. A computer program which executes an output control in an output apparatus which analyzes a command received from an external apparatus to form image data and outputs the formed image data, said program comprising:

code for an error detection step, of detecting an error in the output apparatus;

code for a code assigning step, of assigning an identification code to the error detected in said error detection step;

code for a search step, of searching for a code group that includes the identification code assigned in said code assigning step; and code for a display control step, of controlling a display unit to display information corresponding to the code group searched in said search step, wherein said display control step controls the display unit such that the assigned identification code is divided and displayed in addition to display of the searched code group.

33. A computer program which executes an output control in an output apparatus which analyzes a command received from an external apparatus to form image data and outputs the formed image data, said program comprising:

code for an error detection step, of detecting an error in the output apparatus;

code for an error specifying step, of specifying classification of the error detected in said error detection step;

code for an output control step, of controlling an output unit to output information indicative of the error detected in said error detection step, wherein said control step further controls the output unit to output the error classification specified in said error specifying step; and code for a switch control step, of controlling switching between output of the information indicative of the detected error and output of the specified error classification in response to input of a predetermined instruction.

34. A printing apparatus which performs printing based on a command received from a host computer, said printing apparatus comprising:

error specifying means for specifying an identification code and an error group for an error detected in said printing apparatus; and display means for displaying information for the identification code specified by said error specifying means and information for the error group specified by said error specifying means separately from each other in response to depressing of an operation button.

<page_root_ref="0" />

<antON="0" />